US007322264B2

(12) United States Patent
Hu

(10) Patent No.: US 7,322,264 B2
(45) Date of Patent: Jan. 29, 2008

(54) EXTRA LONG WRENCH WITH RELIABLE COUPLING EFFECT

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/470,014

(22) Filed: Sep. 5, 2006

(65) Prior Publication Data

US 2007/0175301 A1 Aug. 2, 2007

(30) Foreign Application Priority Data

Jan. 27, 2006 (TW) ..... 95103591 A

(51) Int. Cl.
*B25B 23/16* (2006.01)
*B25G 1/04* (2006.01)

(52) U.S. Cl. ..... 81/177.2; 81/177.85

(58) Field of Classification Search ..... 81/177.2; 403/206, 309, 333, 375
See application file for complete search history.

(56) References Cited

U.S. PATENT DOCUMENTS 5,911,798 A * 6/1999 Arnold ..... 81/177.2
6,691,595 B2 * 2/2004 Hsien ..... 81/124.5
7,024,969 B2 * 4/2006 Smith ..... 81/177.2
2006/0016297 A1 * 1/2006 Smith ..... 81/177.2
2006/0230885 A1 * 10/2006 Olson ..... 81/177.85

* cited by examiner

*Primary Examiner*—David B Thomas
(74) *Attorney, Agent, or Firm*—Alan Kamrath; Kamrath & Associates PA

(57) ABSTRACT

A wrench includes an operative member and an extension. The operative member includes a first end for driving a fastener. The operative member further includes a second end having a connecting portion. The connecting portion includes an engaging hole. The extension includes a receiving hole in an end thereof. The connecting portion of the operative member is received in the receiving hole of the extension. A coupling portion protrudes inward from a perimeter wall defining the receiving hole. The coupling portion is engaged in the engaging hole of the operative member. Another operative member may be coupled to the other end of the extension.

15 Claims, 5 Drawing Sheets

EXTRA LONG WRENCH WITH RELIABLE COUPLING EFFECT

BACKGROUND OF THE INVENTION

1. Field of the Invention

The present invention relates to a wrench and, more particularly, to an extra long wrench.

2. Description of the Related Art

FIG. 1 of the drawings illustrates a conventional wrench 1 having an extra long handle for use in particular situations. However, the amount of metal material required for manufacturing the wrench 1 is increased, leading to an increase in the cost. Further, forging such a long handle is more difficult, and incurs a higher cost, in comparison with a handle with an ordinary length. Mass production of the wrench 1 having an extra long handle is not easy, and the high cost product is not attractive to customers.

FIG. 2 illustrates another conventional extra long wrench 2 includes a hollow handle 7 and two operative members 4 respectively mounted to two ends of the hollow handle 3 by tight fitting. Each operative member includes an inner end engaged in an associated end of the hollow handle 3 and an outer end exposed outside the hollow handle 3 for driving a fastener. The problems encountered in forging of the above-mentioned wrench 1 are avoided while saving material. However, the inner ends of the operative members 4 are liable to disengage from, or undesirably slide into, the hollow handle during use.

In accordance with an aspect of the present invention, a wrench comprises a first operative member and an extension. The first operative member includes a first end adapted for driving a fastener. The first operative member further includes a second end having a connecting portion. The connecting portion includes an engaging hole. The extension includes a receiving hole in an end thereof. The connecting portion of the first operative member is received in the receiving hole of the extension. A coupling portion protrudes inward from a perimeter wall defining the receiving hole. The coupling portion is engaged in the engaging hole of the first operative member.

A second operative member may be mounted to the other end of the extension.

Preferably, the second operative member includes a first end adapted for driving a fastener. The second operative member further includes a second end having a second connecting portion. The connecting portion of the second operative member includes a second engaging hole. The extension includes a second receiving hole in the other end thereof. The second connecting portion of the second operative member is received in the second receiving hole of the extension. A second coupling portion protrudes inward from the perimeter wall defining the second receiving hole. The second coupling portion is engaged in the second engaging hole of the second operative member.

Preferably, the engaging hole of the first operative member extends from a first side of the connecting portion through a second side of the connecting portion.

Preferably, the end of the extension includes a third coupling portion protruding inward from the perimeter wall defining the receiving hole of the end of the extension and opposite to the coupling portion of the end of the extension. The coupling portion and the third coupling portion of the end of the extension are respectively engaged in two ends of the engaging hole of the first operative member.

Preferably, the second engaging hole of the second operative member extends from a first side of the second connecting portion through a second side of the second connecting portion.

Preferably, the other end of the extension includes a second coupling portion protruding inward from the perimeter wall defining the second receiving hole of the extension and opposite to a fourth coupling portion of the other end of the extension. The second coupling portion and the fourth coupling portion of the other end of the extension are respectively engaged in two ends of the second engaging hole of the second operative member.

Preferably, the receiving hole and the second receiving hole of the extension are end portions of a longitudinal through-hole extending from the end of the extension through the other end of the extension.

Preferably, the extension is tubular and rectangular in section.

Preferably, the receiving hole is rectangular in section.

In accordance with another aspect of the present invention, a wrench comprises a handle and two operative members. The handle includes two ends each having a receiving hole. A coupling portion protrudes inward from a perimeter wall defining each receiving hole. Each operative member includes a first end adapted for driving a fastener and a second end having a connecting portion received in an associated one of the receiving holes of the handle. Each connecting portion includes an engaging hole. The coupling portion of each end of the handle is engaged in the engaging hole of an associated operative member.

Preferably, the engaging hole of each operative member extends from a first side of the connecting portion through a second side of the connecting portion of the operative member.

Preferably, the receiving holes of the handle are end portions of a longitudinal through-hole extending through a longitudinal length of the handle.

In accordance with a further aspect of the present invention, a wrench comprises a handle and two operative members. The handle includes first and second ends. A longitudinal through-hole extends from the first end through the second end of the handle. The longitudinal through-hole has two ends each defining a receiving hole. Two coupling portions respectively protrude from two opposite walls defining each receiving hole. Each operative member includes a first end adapted for driving a fastener and a second end having a connecting portion received in an associated receiving hole of the handle. Each connecting portion includes an engaging hole extending from a first side through a second side of the connecting portion. The coupling portions of each end of the handle are respectively engaged in two ends of the engaging hole of an associated operative member.

Other objectives, advantages, and features of the invention will become more apparent from the following detailed description when taken in conjunction with the accompanying drawings.

DETAILED DESCRIPTION OF THE PREFERRED EMBODIMENT

Figure 1:
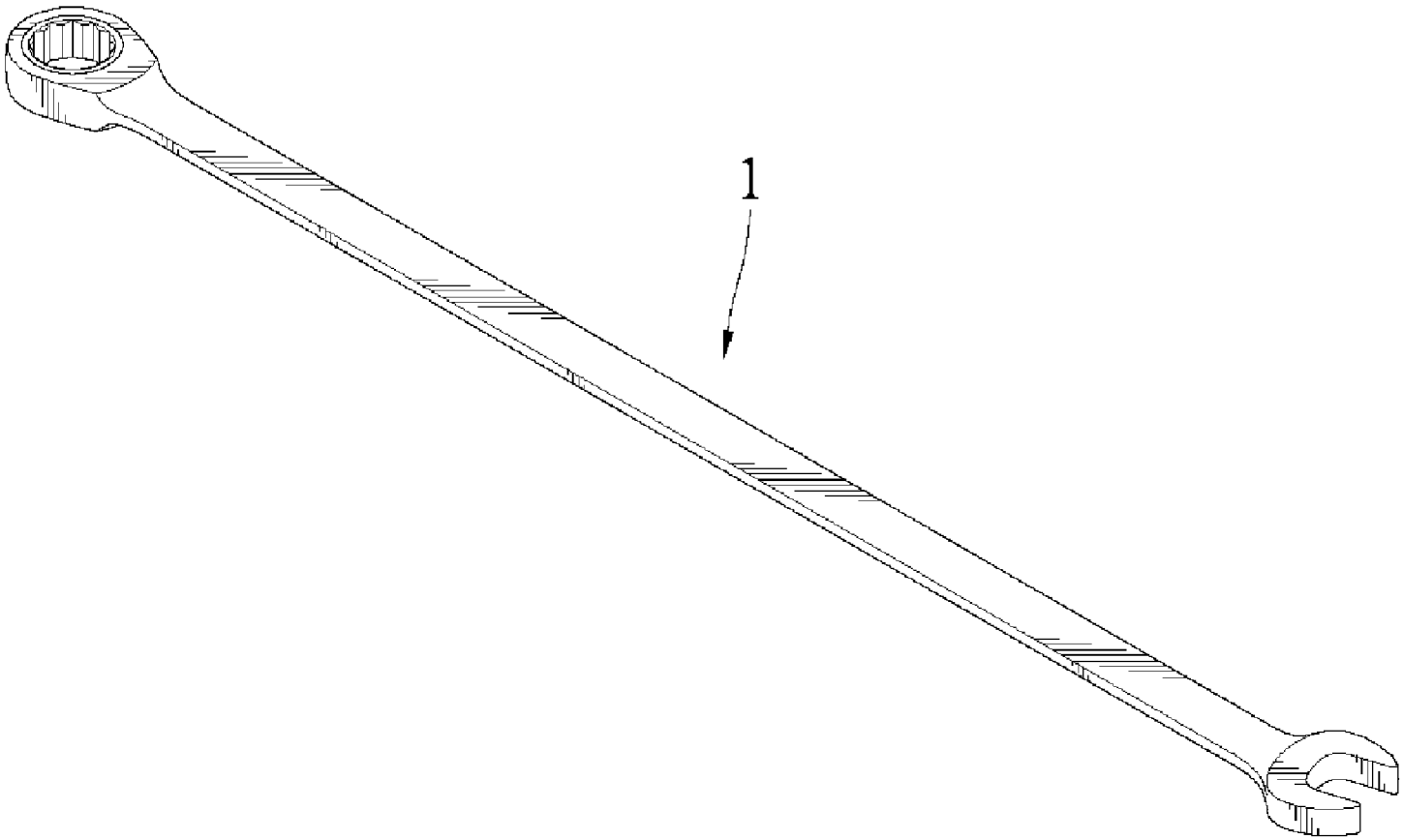
Fig. 1 PRIOR ART
FIG. 1 is a perspective view of a conventional wrench with an extra long handle.
Figure 2:
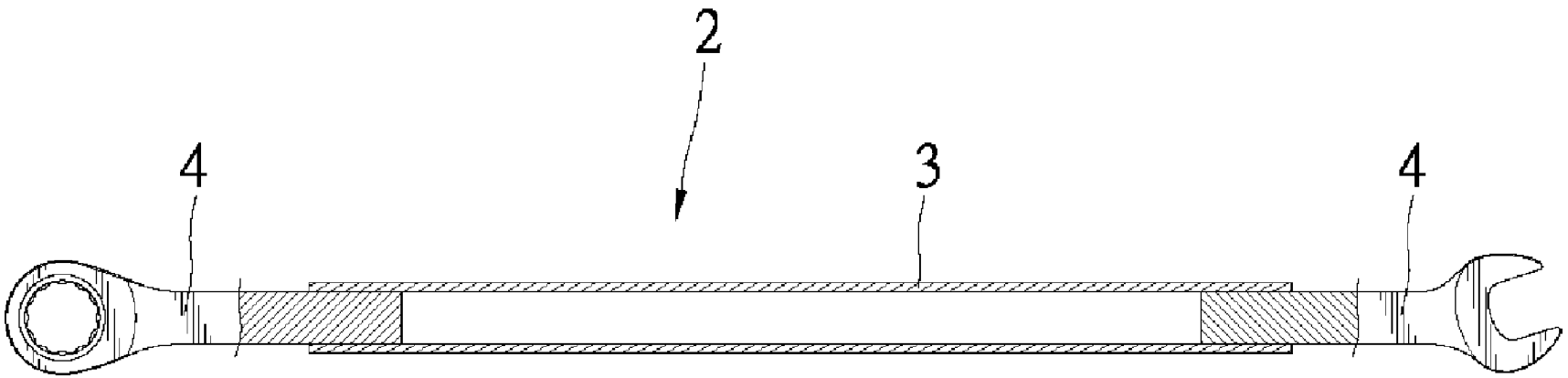
Fig. 2 PRIOR ART
FIG. 2 is a sectional view of another conventional extra long wrench.
Figure 3:
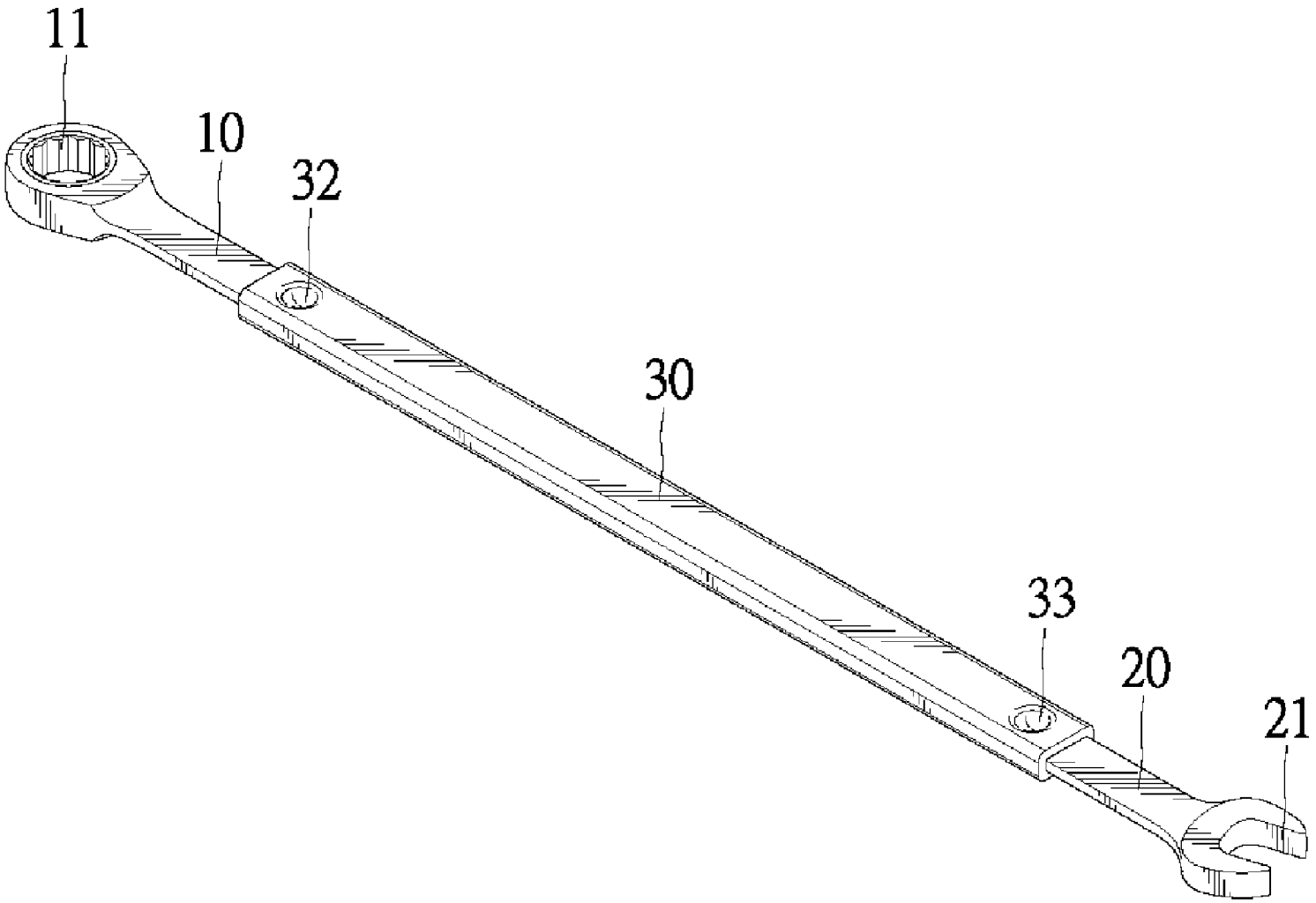
FIG. 3 is a perspective view of an extra long wrench in accordance with the present invention.
Figure 4:
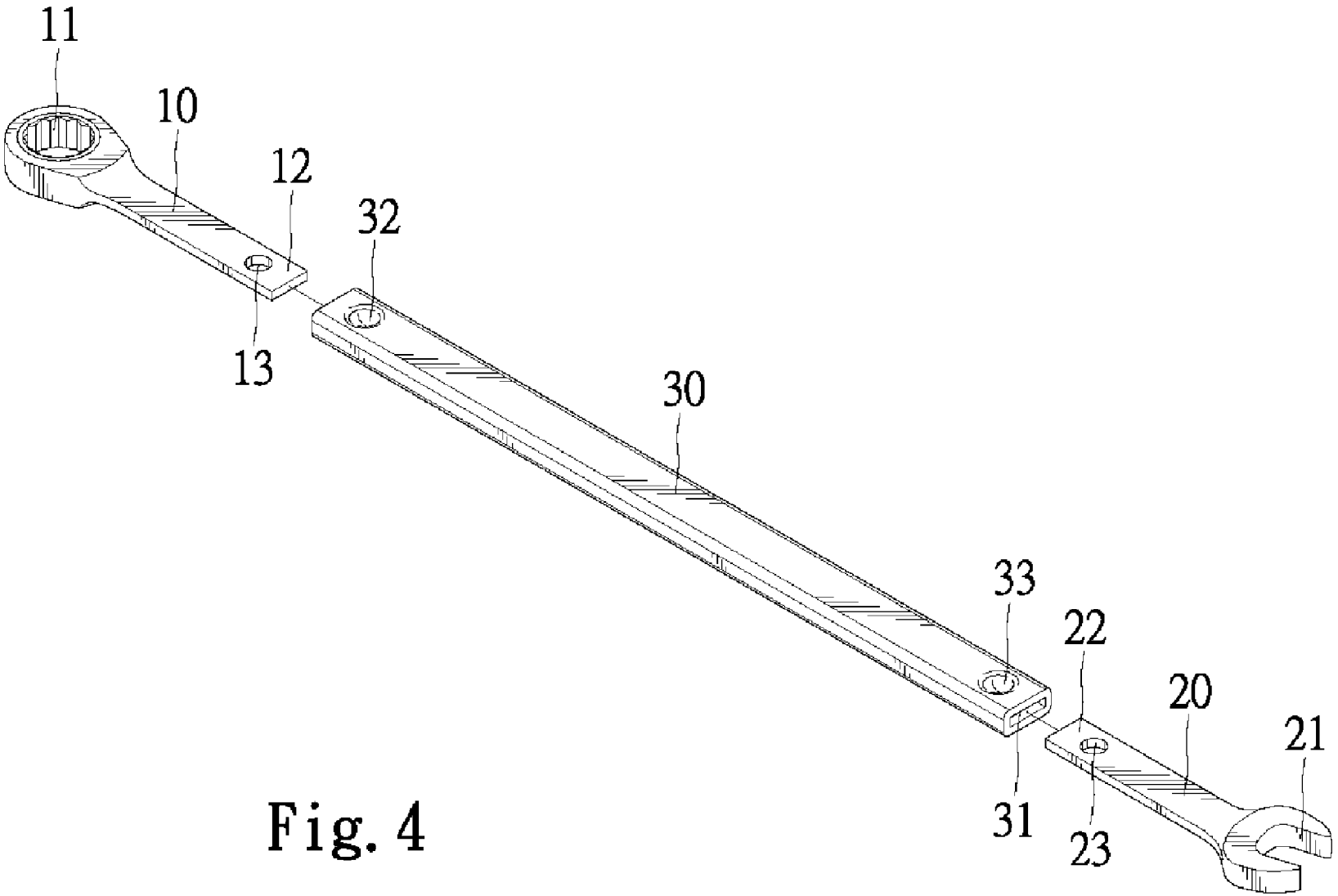
FIG. 4 is an exploded perspective view of the extra long wrench in accordance with the present invention.
Figure 5:
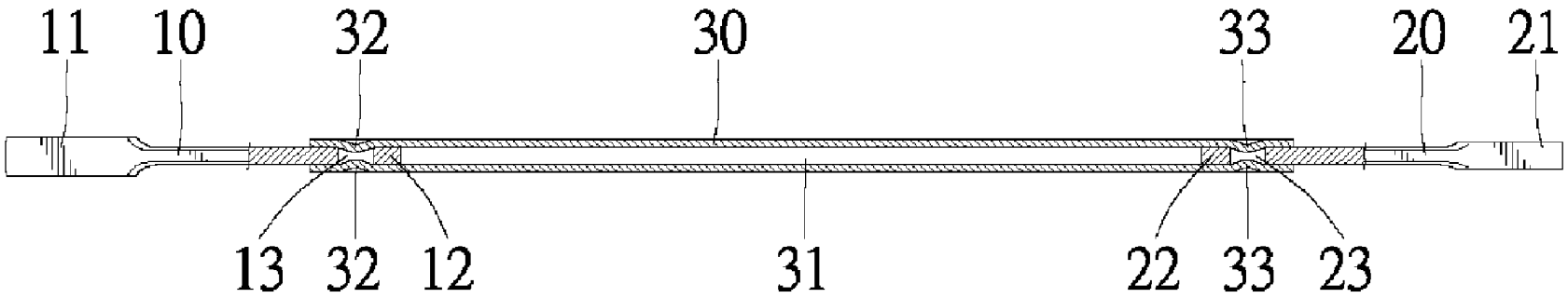
FIG. 5 is a sectional view of the extra long wrench in accordance with the present invention.

Referring to FIGS. 3 through 5, an extra long wrench in accordance with the present invention comprises a first operative member 10, a second operative member 20, and a handle or extension 30. The first operative member 10 includes a first end and a second end. The first end of the first operative member 10 includes an operative portion 11 for driving a fastener such as a bolt, nut, or the like. The second end of the first operative member 10 includes a connecting portion 12 with an engaging hole 13 extending from a first side through a second side of the connecting portion 12.

The second operative member 20 includes a first end and a second end. The first end of the second operative member 20 includes an operative portion 21 for driving a fastener such as a bolt, nut, or the like. The second end of the second operative member 20 includes a connecting portion 22 with an engaging hole 23 extending from a first side through a second side of the connecting portion 22.

The extension 30 includes a first end that may be coupled to the first operative member 10 and a second end that may be coupled to the second operative member 20, providing an extra long handle while providing a reliable coupling effect. The extension 30 includes a receiving hole 31 in each end thereof. In this embodiment, the receiving holes 31 are end portions of a longitudinal hole extending from an end through the other end of the extension 30. In this example, the extension 30 is tubular and rectangular in section. The receiving holes 31 are also rectangular in section.

The connecting portion 12 of the first operative member 10 may be inserted into the receiving hole 31 in an end of the extension 30. A coupling portion 32 protrudes inward from a perimeter wall defining the receiving hole 31 in the end of the extension 30. The connecting portion 12 of the first operative member 10 is securely engaged in the receiving hole 31 of the end of the extension 30 by the coupling portion 32 that is securely engaged in the engaging hole 13 of the connecting portion 12 of the first operative member 10. In this example, two coupling portions 32 respectively protrude inward from two opposite walls defining the receiving hole 31 of the end of the extension 30. The coupling portions 32 are respectively engaged in two ends of the engaging hole 13 of the connecting portion 12 of the first operative member 10, further enhancing the coupling effect.

The connecting portion 22 of the second operative member 20 may be inserted into the receiving hole 31 in the other end of the extension 30. A coupling portion 33 protrudes inward from a perimeter wall defining the receiving hole 31 in the other end of the extension 30. The connecting portion 22 of the second operative member 20 is securely engaged in the receiving hole 31 of the other end of the extension 30 by the coupling portion 33 that is securely engaged in the engaging hole 23 of the connecting portion 22 of the second operative member 20. In this example, two coupling portions 33 respectively protrude inward from two opposite walls defining the receiving hole 31 of the other end of the extension 30. The coupling portions 33 are respectively engaged in two end of the engaging hole 23 of the connecting portion 22 of the second operative member 20, further enhancing the coupling effect.

In manufacture, the connecting portions 12 and 22 of the first and second operative members 10 and 20 are inserted into the receiving holes 31 of the ends of the extension 30, and the connecting portions 12 and 22 of the first and second operative members 10 and 20 are then punched to form the respective coupling portions 32 and 33 that protrude into the respective engaging holes 13 and 23 of the first and second operative members 10 and 20.

Since each operative member 10,20 includes an engaging hole 13, 23 for reliable engagement with the coupling portions 32 and 33 of the extension 30, an extra long wrench with a reliable coupling effect is obtained at a low cost. The coupling effect is further enhanced when two coupling portions 32, 33 respectively protrude inward from two opposite walls delimiting each receiving hole 31. One or both of the first and second operative members 10 and 20 can be attached to one or both ends of the extension 30. After coupling, the extension 30 still has a smooth outer surface allowing firm gripping while providing an aesthetic appearance to attract potential customers.

Although specific embodiments have been illustrated and described, numerous modifications and variations are still possible. The scope of the invention is limited by the accompanying claims.

What is claimed is:

1. A wrench comprising:

a first operative member including a first end adapted for driving a fastener, with the first operative member further including a second end having a connecting portion, with the connecting portion having a first side and an opposite second side and including an engaging hole located at the first side of the connecting portion; and an extension including a receiving hole in an end thereof, with the connecting portion of the first operative member being received in the receiving hole of the extension, with the extension having a perimeter wall defining the receiving hole, with the perimeter wall including an opposite wall adjacent the second side, with the extension having a coupling portion, with the coupling portion formed from and protruding inward from the perimeter wall and spaced from the end, with the coupling portion being engaged in the engaging hole of the first operative member at the first side and being spaced from the second side, with the coupling portion securing the extension to the first operative member, with the coupling portion extending towards but spaced from the opposite wall.

2. The wrench as claimed in claim 1 further comprising a second operative member mounted to another end of the extension.

3. The wrench as claimed in claim 2 wherein the second operative member includes a first end adapted for driving a fastener, with the second operative member further including a second end having a second connecting portion, with the second connecting portion of the second operative member having a first side and an opposite second side and including a second engaging hole, with the second engaging hole located at the first side of the second connecting portion, with the extension including a second receiving hole in said another end thereof, with the second connecting portion of the second operative member being received in the second receiving hole of the extension, with the perimeter wall further defining the second receiving hole, with the extension having a second coupling portion, with the second coupling portion formed from and protruding inward from the perimeter wall and spaced from said another end, with the second coupling portion being engaged in the second engaging hole of the second operative member at the first side and spaced from the second side, with the second coupling portion securing the extension to the second operative member, with the second coupling portion extending towards but spaced from the opposite wall.

4. The wrench as claimed in claim 3 wherein the engaging hole of the first operative member extends from the first side of the connecting portion through the second side of the connecting portion.

5. The wrench as claimed in claim 4 wherein the extension includes a third coupling portion formed from and protruding inward from the opposite wall and opposite to the coupling portion, with the third coupling portion spaced from the end, with the third coupling portion being engaged in the engaging hole of the first operative member at the second side, with the third coupling portion spaced from the first side of the connecting portion and further securing the extension to the first operative member, with the third coupling portion extending towards but spaced from the coupling portion.

6. The wrench as claimed in claim 5 wherein the second engaging hole of the second operative member extends from the first side of the second connecting portion through the second side of the second connecting portion.

7. The wrench as claimed in claim 6 wherein the extension includes a fourth coupling portion formed from and protruding inward from the opposite wall and opposite to the second coupling portion, with the fourth coupling portion spaced from said another end, with the fourth coupling portion being engaged in the second engaging hole of the second operative member at the second side, with the fourth coupling portion spaced from the first side of the second connecting portion and further securing the extension to the second operative member, with the fourth coupling portion extending towards but spaced from the second coupling portion.

8. The wrench as claimed in claim 3 wherein the receiving hole and said second receiving hole of the extension are end portions of a longitudinal through-hole extending from the end of the extension through said another end of the extension.

9. The wrench as claimed in claim 4 wherein the receiving hole and said second receiving hole of the extension are end portions of a longitudinal through-hole extending from the end of the extension through said another end of the extension.

10. The wrench as claimed in claim 5 wherein the receiving hole and said second receiving hole of the extension are end portions of a longitudinal through-hole extending from the end of the extension through said another end of the extension.

11. The wrench as claimed in claim 6 wherein the receiving hole and said second receiving hole of the extension are end portions of a longitudinal through-hole extending from the end of the extension through said another end of the extension.

12. The wrench as claimed in claim 7 wherein the receiving hole and said second receiving hole of the extension are end portions of a longitudinal through-hole extending from the end of the extension through said another end of the extension.

13. The wrench as claimed in claim 1 wherein the engaging hole of the first operative member extends from a first side of the connecting portion through a second side of the connecting portion.

14. The wrench as claimed in claim 1 wherein the extension is tubular and rectangular in section.

15. The wrench as claimed in claim 1 wherein the receiving hole is rectangular in section.

* * * * *